US011197109B2

(12) United States Patent
Landolt et al.

(10) Patent No.: US 11,197,109 B2
(45) Date of Patent: Dec. 7, 2021

(54) HEARING DEVICE WITH ACTIVE VENT COMPRISING SOLENOID

(71) Applicant: SONOVA AG, Staefa (CH)

(72) Inventors: Christian Landolt, Mollis (CH); Christian Frei, Staefa (CH); Erwin Kuipers, Wolfhausen (CH); Manuel Weibel, Erlenbach (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 17/094,659

(22) Filed: Nov. 10, 2020

(65) Prior Publication Data

US 2021/0144491 A1 May 13, 2021

(30) Foreign Application Priority Data

Nov. 12, 2019 (EP) ..... 19208549

(51) Int. Cl.
*H04R 25/00* (2006.01)

(52) U.S. Cl.
CPC ..... *H04R 25/60* (2013.01); *H04R 2460/11* (2013.01)

(58) Field of Classification Search
CPC ..... H04R 1/10; H04R 1/1041; H04R 1/28; H04R 1/2803; H04R 25/48; H04R 25/60; H04R 25/65; H04R 25/558; H04R 25/603; H04R 25/652; H04R 2460/09; H04R 2460/11; H04R 2460/15
USPC ..... 381/23.1, 314, 328
See application file for complete search history.

(56) References Cited

U.S. PATENT DOCUMENTS

2010/0166245 A1* 7/2010 Takigawa ..... H04R 1/1041 381/380
2014/0169603 A1* 6/2014 Sacha ..... H04R 25/60 381/324
2016/0150310 A1* 5/2016 Bakalos ..... H04R 1/1083 381/372

(Continued)

FOREIGN PATENT DOCUMENTS

EP 2747455 6/2014
WO 2010034337 4/2010

(Continued)

OTHER PUBLICATIONS

European Search Report received in International Application No. 19208549.6, dated Jan. 28, 2020.

(Continued)

*Primary Examiner* — Harry S Hong
(74) *Attorney, Agent, or Firm* — ALG Intellectual Property, LLC

(57) ABSTRACT

An illustrative hearing device comprises a controller module and a receiver module including a speaker and an active vent which can be switched between an open state and a closed state, wherein the speaker is electrically connected to the controller module by two differential audio lines, wherein the active vent comprises a solenoid with an inductor having a first terminal and a second terminal, the first terminal connected to the controller module via one of the differential audio lines and the second terminal connected to the controller module either via the other one of the differential audio lines or to at least one control output of the controller module via a separate control line.

18 Claims, 6 Drawing Sheets

(56) References Cited

U.S. PATENT DOCUMENTS

| | | | | |
|---|---|---|---|---|
| 2016/0255433 | A1* | 9/2016 | Grinker | H04R 1/2873<br>381/380 |
| 2017/0295425 | A1* | 10/2017 | Grinker | H04R 1/2873 |
| 2020/0005674 | A1* | 1/2020 | Lecat | G09B 5/04 |
| 2020/0252708 | A1* | 8/2020 | Zhu | H04R 1/1075 |
| 2020/0288251 | A1* | 9/2020 | Kuipers | H04R 1/2803 |

FOREIGN PATENT DOCUMENTS

| | | |
|---|---|---|
| WO | 2016137713 | 9/2016 |
| WO | 2019052715 | 3/2019 |

OTHER PUBLICATIONS

Office Action received in E.P. Patent Application No. 19208549.6-1207, dated Oct. 8, 2021.

* cited by examiner

HEARING DEVICE WITH ACTIVE VENT COMPRISING SOLENOID

RELATED APPLICATIONS

The present application claims priority to EP Patent Application No. 19208549.6, filed Nov. 12, 2019, the contents of which are hereby incorporated by reference in their entirety.

BACKGROUND INFORMATION

Users of hearing devices have the option to choose between different acoustical coupling systems. In so called Receiver-In-the-Canal (RIC) devices the loudspeaker also referred to as receiver is worn in the ear-canal of the user. The receiver is connected to a controller module which is typically worn behind the ear. The receiver can be comprised in a custom made earpiece or in a dome. Domes are the bell-shaped earpieces at the end of the tube. Depending on the hearing loss and the preferences the user can choose in a range from open to closed domes or a custom earpiece referring to the degree by which a vent hole in the earpiece is open. In the context of this description an earpiece, which comprises a receiver is referred to as a receiver module.

The mechanical properties of the vent hole in the earpiece strongly influence the occlusion effect and the low frequency amplitude on the eardrum. An open vent has the benefits of less occlusion. The vibration of a person's own voice is reduced.

A closed vent on the other hand has the benefit of a higher low frequency amplitude and is considered beneficial especially when listening to music.

Some receivers have an active vent control. This means a control signal can open and close the vent hole of the earphone. This active vent may be integrated in the receiver case.

The solutions and prototypes which are currently available use a five pin connector with pins for:

Receiver Plus
Receiver Minus
Vent Control Plus
Vent Control Minus
GND (Receiver Housing)

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
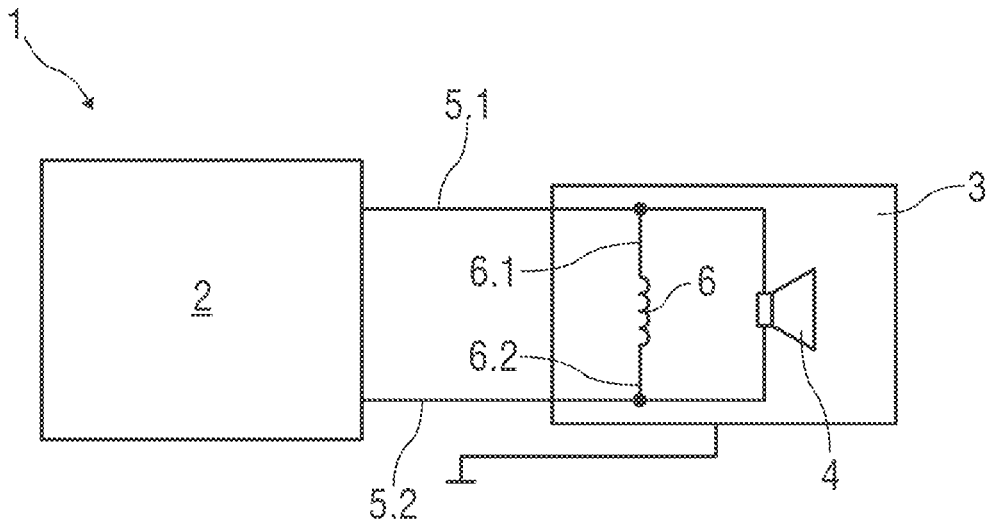
FIG. 1 is a schematic view of a first exemplary embodiment of a hearing device.

An improved hearing device is described herein. An illustrative hearing device comprises a controller module and a receiver module including a speaker and an active vent which can be switched between an open state and a closed state, wherein the speaker is electrically connected to the controller module by two differential audio lines, wherein the active vent comprises a solenoid with an inductor having a first terminal and a second terminal, the first terminal connected to the controller module via one of the differential audio lines and the second terminal connected to the controller module either via the other one of the differential audio lines or to at least one control output of the controller module via a separate control line.

Other than conventional art hearing devices, the hearing device thus needs only two or three distinct electrical connector lines which requires less space and is less likely to create shortcuts while exchanging the receiver.

In an exemplary embodiment, a capacitor is connected in series with the speaker. The capacitor may prevent large currents from flowing through the speaker coil.

In an exemplary embodiment, the control output is capable of adopting a high impedance state. For example, the control output may be tristate, capable of adopting the states high, low and high impedance.

In an exemplary embodiment, the hearing device further comprises at least one semiconductor driver having at least one output and one or more inputs, wherein the second terminal of the inductor is connected to the at least one output of the semiconductor driver, wherein at least one of the one or more inputs of the semiconductor driver may be connected to the at least one control output of the controller module.

In an exemplary embodiment, the at least one semiconductor driver comprises a tri state buffer having an output, a signal input and an enable input, wherein the second terminal is connected to the output of the tri state buffer, wherein the signal input of the tri state buffer is connected to the control output of the controller module, wherein the enable input of the tri state buffer is connected to another control output of the controller module.

In an exemplary embodiment, the at least one semiconductor driver comprises a logic gate having an output, and at least two signal inputs, wherein the second terminal is connected to the output of the logic gate, wherein at least one of the signal inputs of the logic gate is connected to the control output of the controller module, wherein another one of the signal inputs of the logic gate is connected to the differential audio line which is connected to the inductor.

The differential audio line carries a digital signal, e.g. a pulse width modulated (PWM) signal. With the other two control signals it can be decided whether the output of the logic gate is:

the differential audio line signal (which would be the same as the other side of the coil so no current would flow through the coil, or 0 or 1

The three possible states require two control signals.

In an exemplary embodiment, the at least one semiconductor driver comprises a push-pull stage with discrete parts, e.g. at least two transistors arranged as a half-bridge, wherein the second terminal is connected to an output of the half-bridge, wherein a gate or base of each transistor is connected to a respective control output of the controller module.

In an exemplary embodiment, the transistors comprise an n-channel field effect transistor and a p-channel field effect transistor respectively having a gate, a drain and a source, wherein the second terminal is connected to the source of the p-channel field effect transistor and to the drain of the n-channel field effect transistor, wherein each gate is connected to a respective control output of the controller module. In other embodiments, bipolar transistors could be used.

In an exemplary embodiment, a capacitor is connected in parallel with the inductor, wherein a first Schottky diode is arranged to connect one of the transistors to a positive voltage and wherein a second Schottky diode is arranged to connect the other one of the transistors to mass. The capacitor accumulates charge. The Schottky diodes prevent discharge of the capacitor. Depending on the audio signal the PWM signal can have a duty cycle which is not beneficial for switching. By accumulating the charge in a capacitor this becomes less critical. Instead of the Schottky diode, any other diode type would work as well, in particular if the voltage levels are high enough or the voltage drop across the diode is low.

In an exemplary embodiment, the at least one semiconductor driver comprises a Schottky diode, wherein a capacitor is connected in parallel with the inductor, wherein the controller module comprises two output pins, e.g. general purpose input/output (GPIO) expander pins, one of them connected directly to the second terminal and the other one connected to the second terminal via the Schottky diode.

The output pins may be powered by a higher voltage than the audio driver. In an exemplary embodiment the power supply may come from a higher voltage rechargeable battery or pumped up from a zinc air battery. The output pins may be tristate but in an exemplary embodiment two output pins may be provided, one to drive a low signal and the other one to drive a high signal. When the output pin is outputting a high signal switching is not a problem since the high voltage of the output pin has a much higher potential than the output of the audio driver. When outputting a low signal the charge over the capacitor is accumulated with the Schottky diode. Having two output pins avoids having to have a reverse Schottky diode in series when outputting a high signal.

In an exemplary embodiment, the at least one semiconductor driver comprises an analogue switch having an output, at least two control inputs and at least three signal inputs selectively switchable to the output depending on the state of the control inputs, wherein the second terminal is connected to the output, wherein each control input is connected to a respective control output of the controller module, wherein a first one of the signal inputs is connected to a high voltage, a second one of the signal inputs is connected to a low voltage and a third one of the signal inputs is left open or connected to the differential audio line which is connected to the inductor.

In an exemplary embodiment, a capacitor is connected in parallel with the inductor, wherein a Schottky diode is arranged to connect the second signal input to mass.

In an exemplary embodiment, the at least one semiconductor driver comprises a DC/DC converter having a first output, a second output and at least two control inputs, wherein the DC/DC converter is configured to convert a supply voltage to a positive switch voltage which is higher than a voltage on the audio line and wherein the DC/DC converter is configured to convert a supply voltage to a negative switch voltage which is lower than the voltage on the audio line, wherein the second terminal is connected to the first output and to the second output, wherein the control inputs are configured to either switch the first output and the second output into a high impedance state or to switch the positive switch voltage to the first output or to switch the negative voltage to the second output, wherein the solenoid of the active vent is configured to switch only when supplied with a voltage which is higher or lower than the voltage on the audio line.

In an exemplary embodiment, a ground wire is arranged to connect a housing of the receiver module to a ground potential in the controller module or wherein the housing of the receiver module is also connected to the control line and a resistor is arranged to pull the control line to ground.

In an exemplary embodiment, at least one ESD and/or EMI protection device is arranged to protect the audio lines and/or the control line.

In an exemplary embodiment, the controller module is configured as an on-the-ear part or a behind-the-ear part, wherein the receiver module is configured as an in-the-canal part.

In an exemplary embodiment, the hearing device may be configured as a hearing aid.

Further scope of applicability of the embodiments described herein will become apparent from the detailed description given hereinafter. However, it should be understood that the detailed description and specific examples, while indicating illustrative embodiments, are given by way of illustration only, since various changes and modifications within the spirit and scope of the invention will become apparent to those skilled in the art from this detailed description.

FIG. 1 is a schematic view of a first exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2 and the second terminal 6.2 connected to the controller module 2 via the other one of the differential audio lines 5.1, 5.2.

The active vent is therefore driven directly by the differential audio lines 5.1, 5.2 of the loudspeaker driver. The differential audio lines 5.1, 5.2 can be controlled, e.g. by a hardware, with driving capability that is sufficient to switch the vent in both directions, i.e. to open and close the vent. The switching will cause a short interruption of the audio stream.

The same interface, i.e. the audio driver of the controller module 2, drives the audio and the vent without having to scarify the ground pin of the receiver module 3 if any. This embodiment is fully compatible with the 3 pin SDT4 interface. It is possible to identify the receiver type with an impedance measurement.

In an exemplary embodiment, if the audio line 5.1 switches to a high level and the audio line 5.2 switches to a low level, the vent opens. If the audio line 5.1 switches to a low level and the audio line 5.2 switches to a high level, the vent closes. If the audio lines 5.1, 5.2 carry a differential audio signal the vent remains in its current state.

Figure 2:
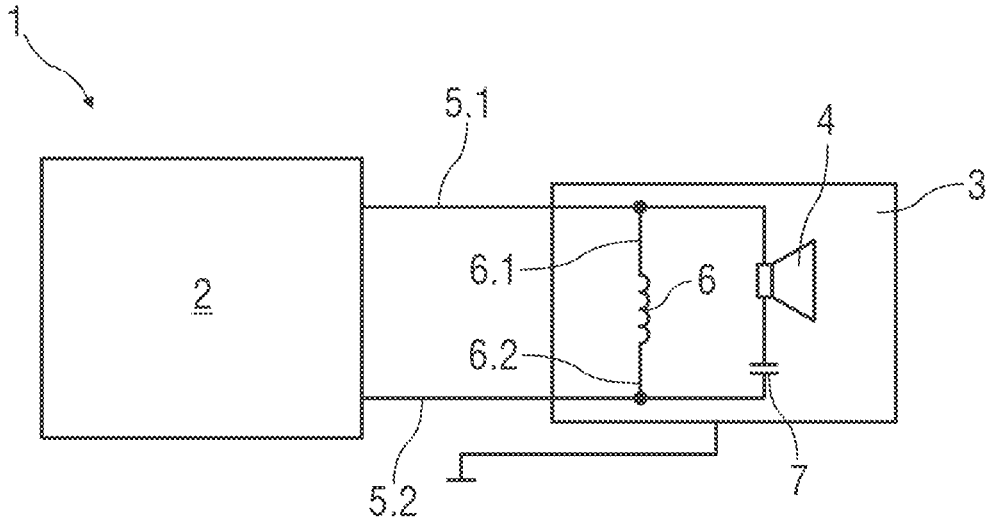
FIG. 2 is a schematic view of a second exemplary embodiment of a hearing device.

FIG. 2 is a schematic view of a second exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2 and the second terminal 6.2 connected to the controller module 2 via the other one of the differential audio lines 5.1, 5.2. A capacitor 7, e.g. having 4.7 μF, is connected in series with the speaker 4.

The active vent is therefore driven directly by the differential audio lines 5.1, 5.2 of the loudspeaker driver. The capacitor 7 in series with the speaker 4 reduces a current peak during switching. The differential audio lines 5.1, 5.2 can be controlled, e.g. by a hardware, with driving capability that is sufficient to switch the vent in both directions, i.e. to open and close the vent. The switching will cause a short interruption of the audio stream.

The same interface, i.e. the audio driver of the controller module 2, drives the audio and the vent without having to scarify the ground pin of the receiver module 3 if any. It is possible to ground the housing of the receiver module 3 with a third wire.

In an exemplary embodiment, if the audio line 5.1 switches to a high level and the audio line 5.2 switches to a low level, the vent opens. If the audio line 5.1 switches to a low level and the audio line 5.2 switches to a high level, the vent closes. If the audio lines 5.1, 5.2 carry a differential audio signal the vent remains in its current state.

Figure 3:
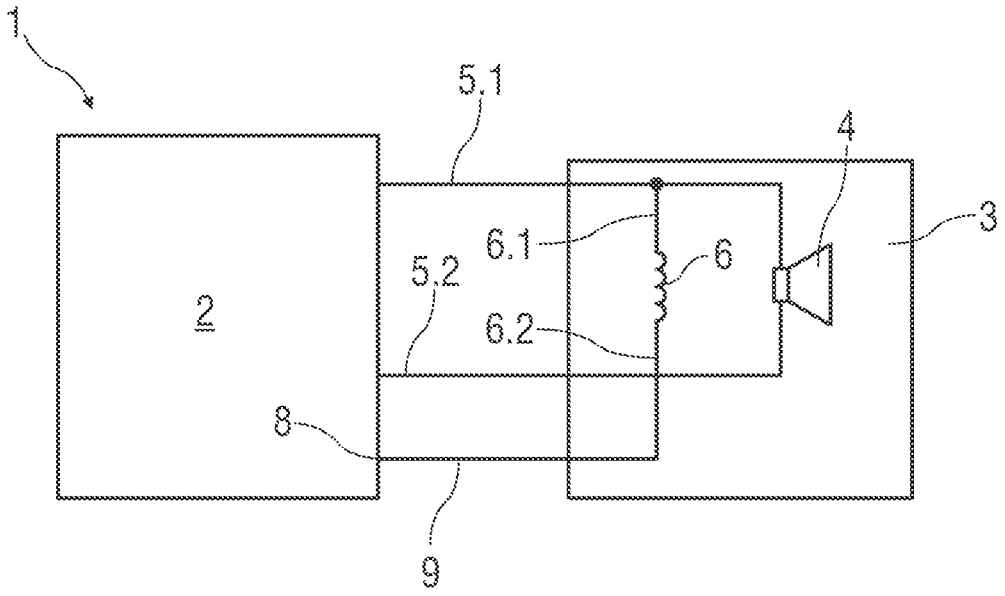
FIG. 3 is a schematic view of a third exemplary embodiment of a hearing device.

FIG. 3 is a schematic view of a third exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2 and the second terminal 6.2 connected to a control output 8 of the controller module 2 via a separate control line 9.

In an exemplary embodiment, the control output 8 is capable of adopting a high impedance state. For example, the control output 8 may be tristate, capable of adopting the states high, low and high impedance.

This option assumes that the control output 8 of the controller module 2 has enough driving capability to supply the necessary current for driving the vent.

By controlling the tristate control output 8, the vent can be switched if enough delta voltage is generated over the vent inductor 6. The control output 8 should be high impedance for normal operation to prevent any additional current through the vent coil.

This embodiment is compatible with the 3 pin SDT4 interface. Controlling the vent will not cause any interruption of the audio stream. It is possible to identify the receiver type. No additional hardware components are required.

In an exemplary embodiment, if the control output 8 switches to a low level, the vent opens. If the control output 8 switches to a high level, the vent closes. If the control output assumes a high impedance state, the vent remains in its current state.

Figure 4:
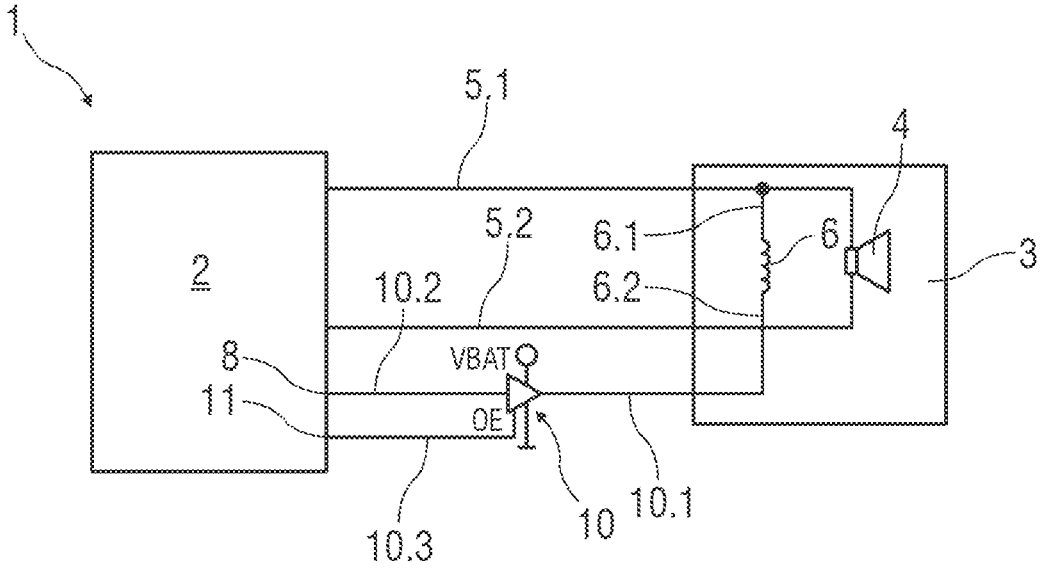
FIG. 4 is a schematic view of a fourth exemplary embodiment of a hearing device.

FIG. 4 is a schematic view of a fourth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein at least one of the one or more inputs 10.2, 10.3 of the semiconductor driver 10 is connected to the at least one control output 8 of the controller module 2.

In the fourth embodiment, the semiconductor driver 10 may be configured as or comprise a tri state buffer having an output 10.1, a signal input 10.2 and an enable input 10.3, wherein the second terminal 6.2 is connected to the output 10.1 of the tri state buffer, wherein the signal input 10.2 of the tri state buffer is connected to the control output 8 of the controller module 2, wherein the enable input 10.3 of the tri state buffer is connected to a further control output 11 of the controller module 2.

The fourth embodiment is an alternative to the third embodiment in case the controller module 2 cannot drive the vent in case of limited driving capability of its IO pins.

This embodiment is compatible with the 3 pin SDT4 interface. Controlling the vent will not cause any interruption of the audio stream. It is possible to identify the receiver type.

In an exemplary embodiment, if the output 10.1 switches to a low level, the vent opens. If the output 10.1 switches to a high level, the vent closes. If the output 10.1 assumes a high impedance state, the vent remains in its current state.

Figure 5:
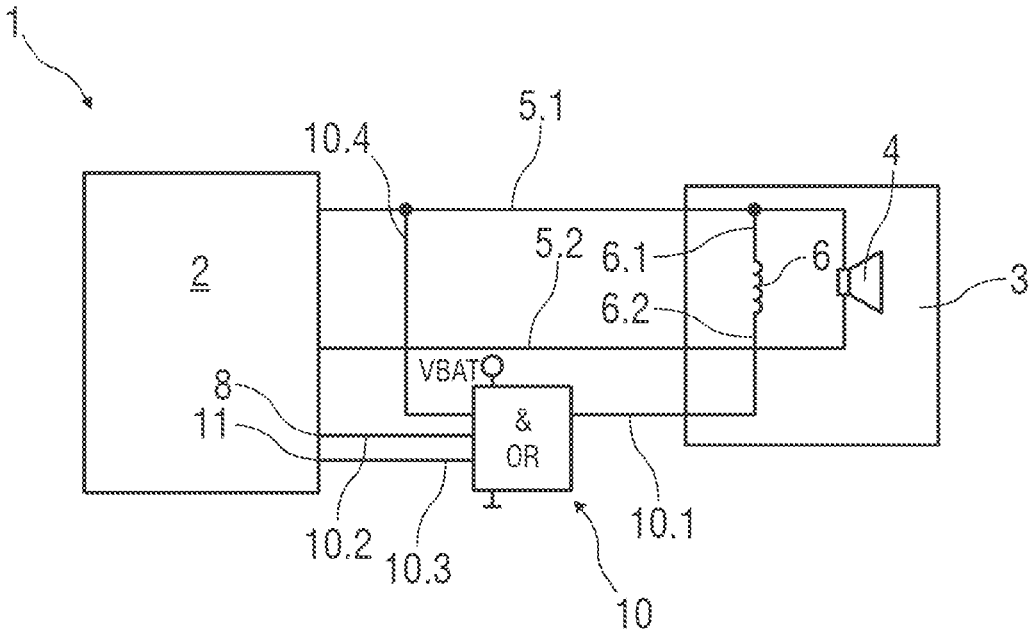
FIG. 5 is a schematic view of a fifth exemplary embodiment of a hearing device.

FIG. 5 is a schematic view of a fifth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, 10.4, wherein the second terminal 6.2 of the inductor 6 is connected to the at least one output 10.1 of the semiconductor driver 10, wherein two of the one or more inputs 10.2, 10.3, 10.4 of the semiconductor driver 10 are connected to the at least one control output 8 and to the further control output 11 of the controller module 2. A third one of the one or more inputs 10.2, 10.3, 10.4 of the semiconductor driver 10 is connected to one of the differential audio lines 5.1, 5.2.

In the fifth embodiment, the semiconductor driver 10 may be configured as or comprise a logic gate having an output 10.1, and at least two, for example three, signal inputs 10.2, 10.3, 10.4, wherein the second terminal 6.2 is connected to the output 10.1 of the logic gate, wherein at least one of the signal inputs 10.2 of the logic gate is connected to the control output 8 of the controller module 2, wherein another one of the signal inputs 10.4 of the logic gate is connected to the differential audio line 5.1 which is connected to the inductor 6. Yet another one of the signal inputs 10.3 may be connected to the further control output 11 of the controller module 2.

The differential audio lines 5.1, 5.2 carry a digital signal, e.g. a pulse width modulated (PWM) signal. With the other two control signals on signal inputs 10.2, 10.3 it can be decided whether the output 10.1 of the logic gate is:

the differential audio line signal 5.1 (which would be the same as the other side of the inductor 6 so no current would flow through the inductor 6, or low or high.

These three possible states require two control signals.

The fifth embodiment is an alternative to the third embodiment in case the controller module 2 cannot drive the vent in case of limited driving capability of its IO pins.

This embodiment is compatible with the 3 pin SDT4 interface. Controlling the vent will not cause any interruption of the audio stream. It is possible to identify the receiver type.

In an exemplary embodiment, if the output 10.1 switches to a low level, the vent opens. If the output 10.1 switches to a high level, the vent closes. If the differential audio signal is switched onto output 10.1, the vent remains in its current state.

Figure 6:
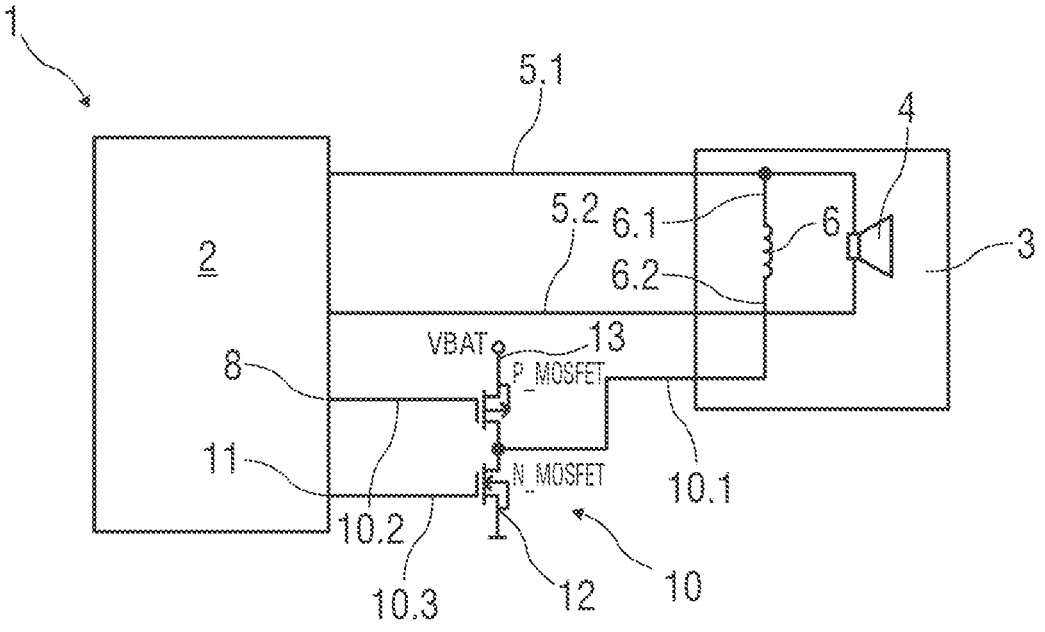
FIG. 6 is a schematic view of a sixth exemplary embodiment of a hearing device.

FIG. 6 is a schematic view of a sixth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein the one or more inputs 10.2, 10.3 of the semiconductor driver 10 are connected to the at least one control output 8 and to the further control output 11 of the controller module 2.

The at least one semiconductor driver 10 comprises two transistors 12, 13 arranged as a half-bridge, wherein the second terminal 6.2 is connected to an output 10.1 of the half-bridge, wherein a gate or base of each transistor 12, 13 is connected to a respective control output 8, 11 of the controller module 2.

In the sixth embodiment the transistors 12, 13 comprise an n-channel field effect transistor 12 and a p-channel field effect transistor 13 respectively having a gate, a drain and a source, wherein the second terminal 6.2 is connected to the source of the p-channel field effect transistor 13 and to the drain of the n-channel field effect transistor 12, wherein each gate is connected to a respective control output 8, 11 of the controller module 2. In alternative embodiments, the transistors 12, 13 may be bipolar transistors or other types of field effect transistors.

The sixth embodiment is an alternative to the third embodiment in case the controller module 2 cannot drive the vent in case of limited driving capability of its IO pins.

This embodiment is compatible with the 3 pin SDT4 interface. Controlling the vent will not cause any interruption of the audio stream. It is possible to identify the receiver type.

In an exemplary embodiment, if the output 10.1 switches to a low level, the vent opens. If the output 10.1 switches to a high level, the vent closes. If the output 10.1 is switched into a high impedance state, the vent remains in its current state.

Figure 7:
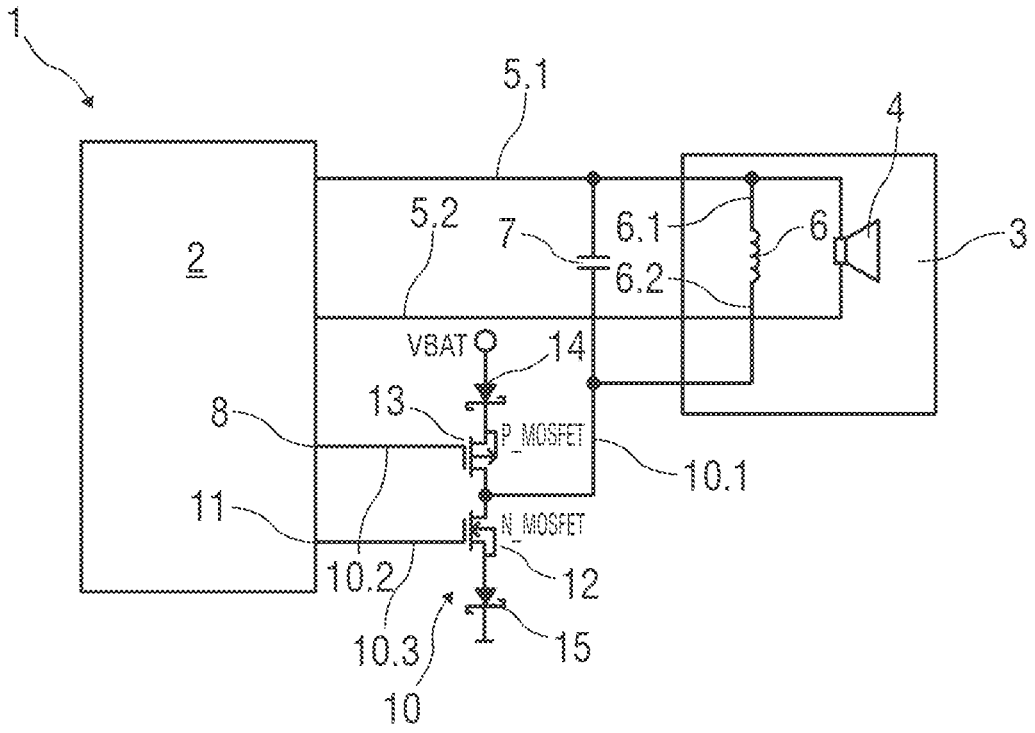
FIG. 7 is a schematic view of a seventh exemplary embodiment of a hearing device.

FIG. 7 is a schematic view of a seventh exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein the one or more inputs 10.2, 10.3 of the semiconductor driver 10 are connected to the at least one control output 8 and to the further control output 11 of the controller module 2.

The at least one semiconductor driver 10 comprises two transistors 12, 13 arranged as a half-bridge, wherein the second terminal 6.2 is connected to an output 10.1 of the half-bridge, wherein a gate or base of each transistor 12, 13 is connected to a respective control output 8, 11 of the controller module 2.

In the seventh embodiment the transistors 12, 13 comprise an n-channel field effect transistor 12 and a p-channel field effect transistor 13 respectively having a gate, a drain and a source, wherein the second terminal 6.2 is connected to the source of the p-channel field effect transistor 13 and to the drain of the n-channel field effect transistor 12, wherein each gate is connected to a respective control output 8, 11 of the controller module 2.

A capacitor 7, e.g. having 22 μF, is connected in parallel with the inductor 6, wherein a first Schottky diode 14 is arranged to connect one of the transistors 13 to a positive voltage VBAT and wherein a second Schottky diode 15 is arranged to connect the other one of the transistors 12 to mass.

The seventh embodiment is an option of the sixth embodiment. The vent is connected to one of the differential audio output lines 5.1 and on the other side to the output of a tristate NMOS/PMOS circuit comprising the transistors 12, 13. With the help of the Schottky diodes 14, 15 the energy is accumulated in the capacitor 7 which makes the switching more reliable.

This embodiment is compatible with the 3 pin SDT4 interface. Controlling the vent will not cause any interruption of the audio stream. It is possible to identify the receiver type. The capacitor 7 accumulates charge. The Schottky diodes 14, 15 prevent discharge of the capacitor 7. The PWM signal can have a duty cycle which is not beneficial for switching. By accumulating the charge in a capacitor 7 this becomes less critical. Instead of the Schottky diodes 14, 15, any other diode type would work as well, in particular if the voltage levels are high enough or the voltage drop across the diode 14, 15 is low.

In an exemplary embodiment, if the output 10.1 switches to a low level, the vent opens. If the output 10.1 switches to a high level, the vent closes. If the output 10.1 is switched into a high impedance state, the vent remains in its current state.

Figure 8:
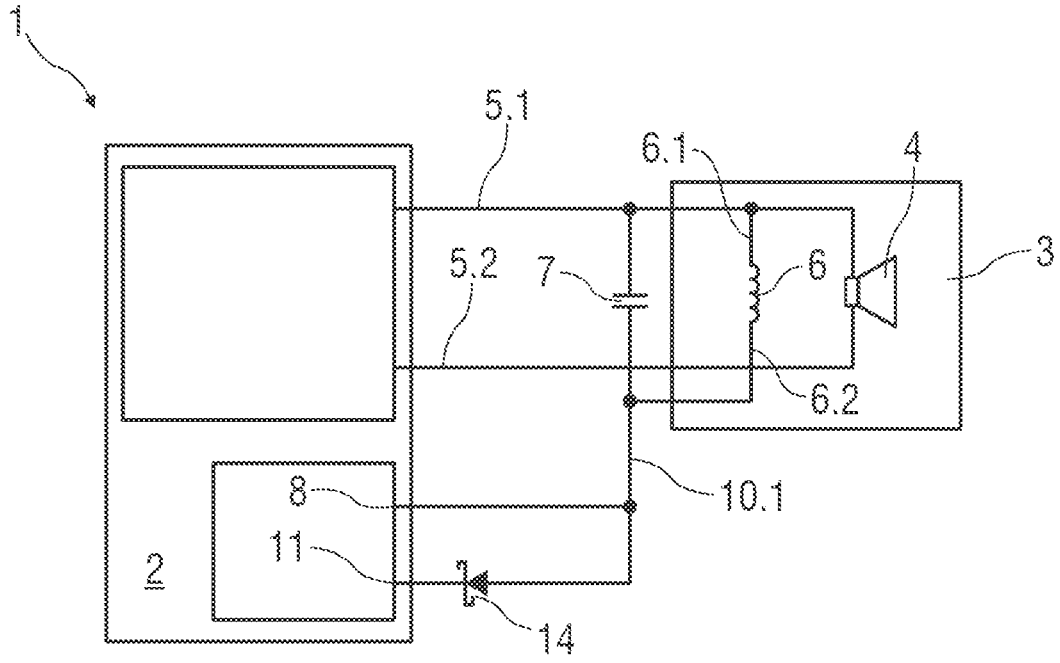
FIG. 8 is a schematic view of a eighth exemplary embodiment of a hearing device.

FIG. 8 is a schematic view of a eighth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein the one or more inputs 10.2, 10.3 of the semiconductor driver 10 are connected to the at least one control output 8 and to the further control output 11 of the controller module 2.

The at least one semiconductor driver 10 comprises a Schottky diode 14, wherein a capacitor 7, e.g. having 22 μF, is connected in parallel with the inductor 6, wherein the controller module 2 comprises two general purpose input/output expander pins 8, 11, one of them connected directly to the second terminal 6.2 and the other one connected to the second terminal 6.2 via the Schottky diode 14.

The eighth embodiment is dedicated to rechargeable platforms, where higher voltage levels than those of the PWM signal may be available. The vent in that case is connected to one of the differential audio output lines 5.1 and on the other side to the output of two output pins 8, 11, e.g. GPIO expander pins, powered at higher voltage. With the help of the Schottky diode 14 the energy is accumulated in the capacitor 7 which makes the switching more reliable.

The eighth embodiment is compatible with the 3 pin SDT4 interface. Controlling the vent will not cause any interruption of the audio stream. It is possible to identify the receiver type.

In an exemplary embodiment, if the output 10.1 switches to a low level, the vent opens. If the output 10.1 switches to a high level, the vent closes. If the output 10.1 is switched into a high impedance state, the vent remains in its current state.

Figure 9:
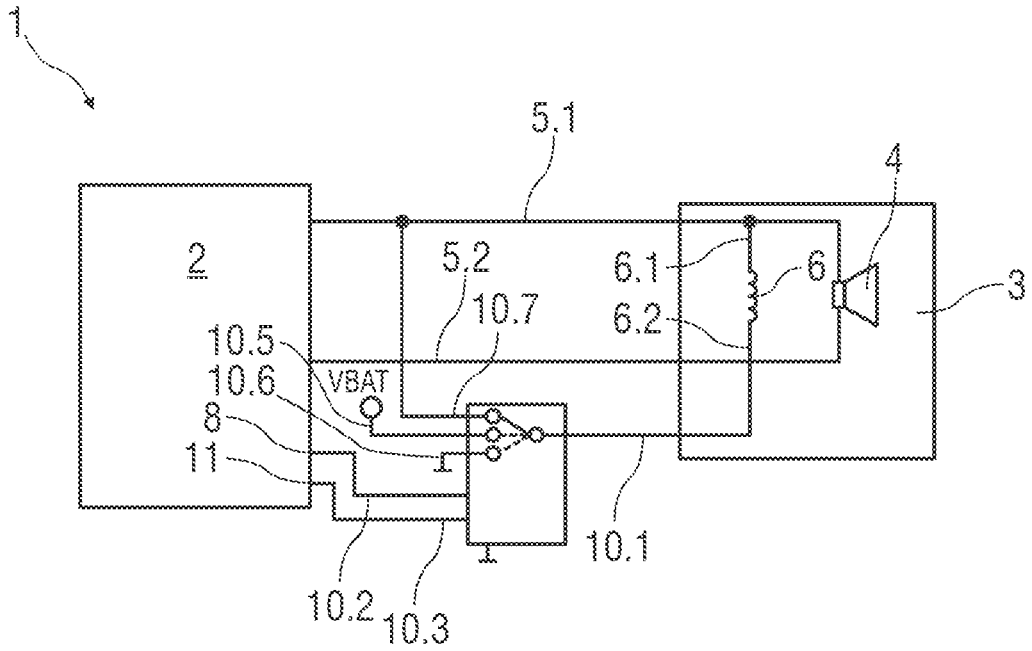
FIG. 9 is a schematic view of a ninth exemplary embodiment of a hearing device.

FIG. 9 is a schematic view of a ninth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein some of the one or more inputs 10.2, 10.3 of the semiconductor driver 10 are connected to the at least one control output 8 and to the further control output 11 of the controller module 2.

The at least one semiconductor driver 10 comprises an analogue switch having an output 10.1, at least two control inputs 10.2, 10.3 and at least three signal inputs 10.5, 10.6, 10.7 selectively switchable to the output 10.1 depending on the state of the control inputs 10.2, 10.3, wherein the second terminal 6.2 is connected to the output 10.1, wherein each control input 10.2, 10.3 is connected to a respective control output 8, 11 of the controller module 2, wherein a first one of the signal inputs 10.5 is connected to a positive voltage VBAT, a second one of the signal inputs 10.6 is connected to a low voltage or mass or negative voltage and a third one of the signal inputs 10.7 is left open or connected to the differential audio line 5.1 which is connected to the inductor 6.

In this option the vent is connected to one of the differential audio output lines 5.1 and to the analog switch output 10.1. The signal inputs 10.5, 10.6, 10.7 of the 3-position analog switch is a low signal, a high signal and the same differential audio line 5.1 to which the vent is connected. Instead of being connected to the audio line 5.1, the third signal input 10.7 could also be left open to prevent flowing current in the non-switching use case. This solution could also be combined with the Schottky diode 14 and capacitor 7 approach from the eighth embodiment to make the switching more reliable.

The ninth embodiment is compatible with the 3 pin SDT4 interface. Controlling the vent will not cause any interruption of the audio stream. It is possible to identify the receiver type.

In an exemplary embodiment, if the output 10.1 switches to a low level, the vent opens. If the output 10.1 switches to a high level, the vent closes. If the differential audio signal is switched onto output 10.1 or if the output 10.1 is switched into a high impedance state, the vent remains in its current state.

Figure 10:
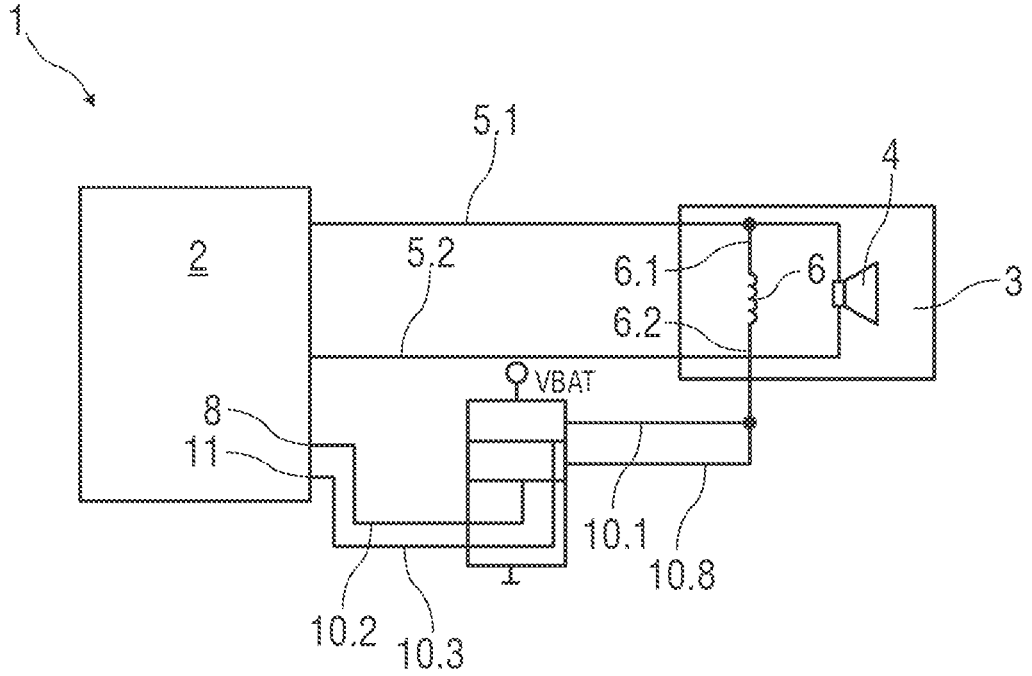
FIG. 10 is a schematic view of a tenth exemplary embodiment of a hearing device.

FIG. 10 is a schematic view of a tenth exemplary embodiment of a hearing device 1.

The hearing device 1 comprises a controller module 2 and a receiver module 3 including a speaker 4 and an active vent which can be switched between an open state and a closed state, wherein the speaker 4 is electrically connected to the controller module 2 by two differential audio lines 5.1, 5.2, wherein the active vent comprises a solenoid with an inductor 6 having a first terminal 6.1 and a second terminal 6.2, the first terminal 6.1 connected to the controller module 2 via one of the differential audio lines 5.1, 5.2.

A semiconductor driver 10 is provided having at least one output 10.1 and one or more inputs 10.2, 10.3, wherein the second terminal 6.2 of the inductor 6 is connected to the at least one output 10.1 of the semiconductor driver 10, wherein some of the one or more inputs 10.2, 10.3 of the semiconductor driver 10 are connected to the at least one control output 8 and to the further control output 11 of the controller module 2.

The at least one semiconductor driver 10 comprises a DC/DC converter having a first output 10.1, a second output 10.8 and at least two control inputs 10.2, 10.3, wherein the DC/DC converter is configured to convert a supply voltage VBAT to a positive switch voltage which is higher than a voltage on the audio line 5.1, 5.2 and wherein the DC/DC converter is configured to convert a supply voltage VBAT to a negative switch voltage which is lower than the voltage on the audio line 5.1, 5.2, wherein the second terminal 6.2 is connected to the first output 10.1 and to the second output 10.8, wherein the control inputs 10.2, 10.3 are configured to either switch the first output 10.1 and the second output 10.8 into a high impedance state or to switch the positive switch voltage to the first output 10.1 or to switch the negative voltage to the second output 10.8, wherein the solenoid of the active vent is configured to switch only when supplied with a voltage which is higher or lower than the voltage on the audio line 5.1, 5.2.

In the tenth embodiment the vent is connected to one of the differential audio output lines 5.1 and to the output of a DC/DC converter. The DC/DC converter can generate a switching signal which is always clearly higher or lower than the differential audio line 5.1. This could be done for example with a voltage doubler for the positive switching and a voltage inverter for the negative switching. The DC/DC converter could also be implemented with discrete components like capacitors and diodes.

The tenth embodiment is compatible with the 3 pin SDT4 interface. Controlling the vent will not cause any interruption of the audio stream. It is possible to identify the receiver type. There is no dependency from the audio signal or the supply voltage.

In an exemplary embodiment, if the output 10.1 switches to a negative voltage, the vent opens. If the output 10.1 switches to a higher positive voltage, the vent closes. If the output 10.1 is switched into a high impedance state, the vent remains in its current state.

Figure 11:
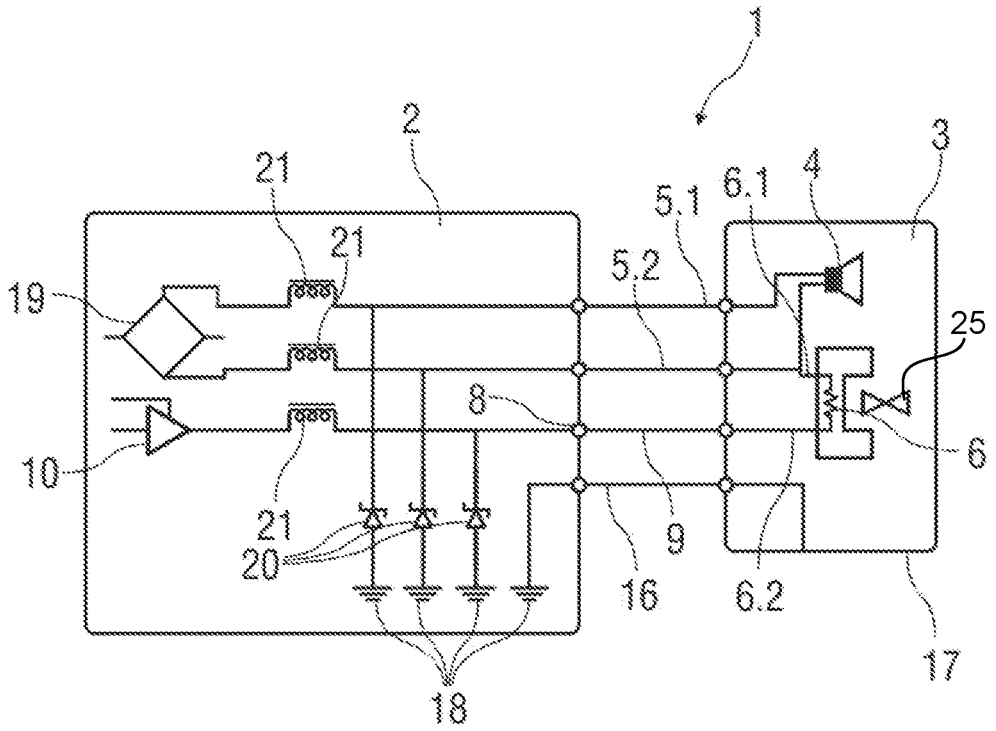
FIG. 11 is a schematic view of an eleventh exemplary embodiment of a hearing device.

FIG. 11 is a schematic view of an eleventh exemplary embodiment of a hearing device 1.

The hearing device 1 comprises a controller module 2 and a receiver module 3 including a speaker 4 and an active vent 25 which can be switched between an open state and a closed state, wherein the speaker 4 is electrically connected to the controller module 2 by two differential audio lines 5.1, 5.2, wherein the active vent 25 comprises a solenoid with an inductor 6 having a first terminal 6.1 and a second terminal 6.2, the first terminal 6.1 connected to the controller module 2 via one of the differential audio lines 5.1, 5.2 and the second terminal 6.2 connected to a control output 8 of the controller module 2 via a separate control line 9.

A ground wire 16 is arranged to connect a housing 17 of the receiver module 3 to a ground 18 potential in the controller module 2.

The controller module 2 comprises an amplifier 19, e.g. an H-bridge, to drive the speaker 4.

In an exemplary embodiment, the control output 8 is capable of adopting a high impedance state. For example, the control output 8 may be tristate, capable of adopting the states high, low and high impedance. This may be achieved by a semiconductor driver 10 within the control module 2, the semiconductor driver 10 configured as a tri state buffer.

By controlling the tristate control output 8, the vent can be switched if enough delta voltage is generated over the vent inductor 6. The control output 8 should be high impedance for normal operation to prevent any additional current through the vent coil.

In an exemplary embodiment, if the control output 8 switches to a low level, the vent opens. If the control output 8 switches to a high level, the vent closes. If the control output assumes a high impedance state, the vent remains in its current state.

For ESD/EMI protection a respective TVS diode 20 (TVS—transient voltage suppressor) may connect each audio line 5.1, 5.2 and the control line 9 to ground 18 within the control module 2. A respective ferrite bead 21 may be arranged in each audio line 5.1, 5.2 and in the control line 9 within the control module 2, e.g. between a respective output of the amplifier 19 and the respective TVS diode 20 and between an output of the semiconductor driver 10 and the respective TVS diode 20.

To avoid artefacts on the differential output for the speaker 4, both outputs of the amplifier 19 may have the same DC offset during the time of switching the vent so the speaker 4 does not create any output during switching.

Figure 12:
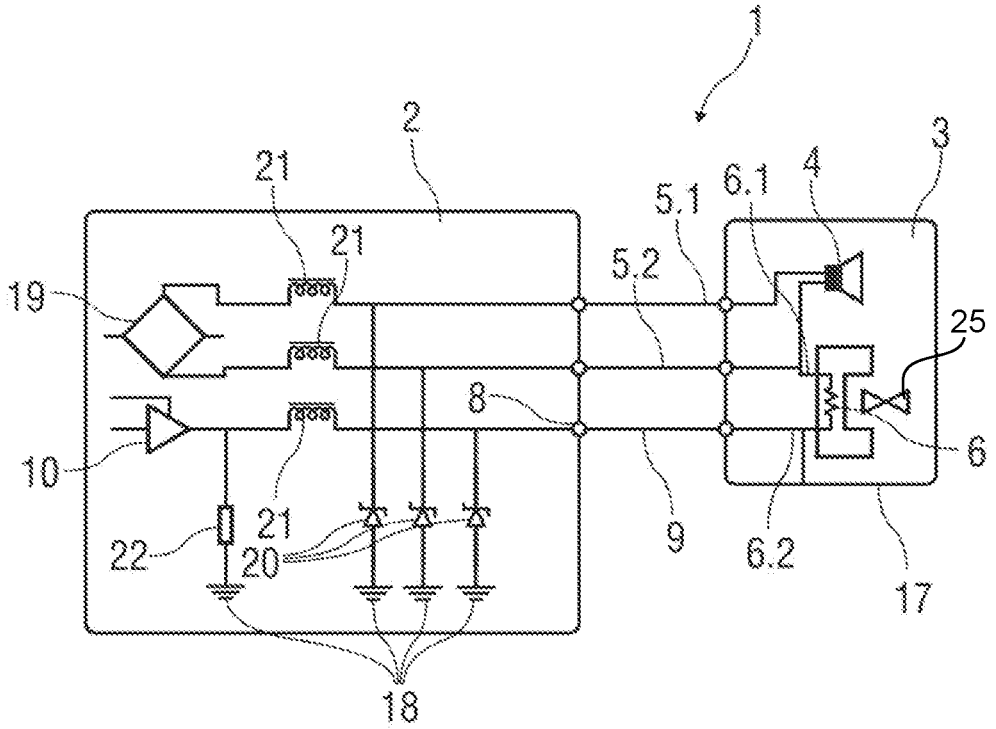
FIG. 12 is a schematic view of a twelfth exemplary embodiment of a hearing device.

FIG. 12 is a schematic view of a twelfth exemplary embodiment of a hearing device 1.

The hearing device 1 comprises a controller module 2 and a receiver module 3 including a speaker 4 and an active vent 25 which can be switched between an open state and a closed state, wherein the speaker 4 is electrically connected to the controller module 2 by two differential audio lines 5.1, 5.2, wherein the active vent 25 comprises a solenoid with an inductor 6 having a first terminal 6.1 and a second terminal 6.2, the first terminal 6.1 connected to the controller module 2 via one of the differential audio lines 5.1, 5.2 and the second terminal 6.2 connected to a control output 8 of the controller module 2 via a separate control line 9.

The controller module 2 comprises an amplifier 19, e.g. an H-bridge, to drive the speaker 4.

In an exemplary embodiment, the control output 8 is capable of adopting a high impedance state. For example, the control output 8 may be tristate, capable of adopting the states high, low and high impedance. This may be achieved by a semiconductor driver 10 within the control module 2, the semiconductor driver 10 configured as a tri state buffer.

By controlling the tristate control output 8, the vent can be switched if enough delta voltage is generated over the vent inductor 6. The control output 8 should be high impedance for normal operation to prevent any additional current through the vent coil.

In an exemplary embodiment, if the control output 8 switches to a low level, the vent opens. If the control output 8 switches to a high level, the vent closes. If the control output assumes a high impedance state, the vent remains in its current state.

For ESD/EMI protection a respective TVS diode 20 may connect each audio line 5.1, 5.2 and the control line 9 to ground 18 within the control module 2. A respective ferrite bead 21 may be arranged in each audio line 5.1, 5.2 and in the control line 9 within the control module 2, e.g. between a respective output of the amplifier 19 and the respective TVS diode 20 and between an output of the semiconductor driver 10 and the respective TVS diode 20.

A resistor 22 may be arranged to pull the output of the semiconductor driver 10 to ground 18. A housing 17 of the receiver module 3 is also connected to the control line 9. The idea is to connect the housing 17 of the receiver module 3 to the same potential as the vent driver signal. Although the housing 17 is thus not directly connected to ground 18, it has though always a defined potential which helps meeting the ESD and EMI requirements.

In an exemplary embodiment, the resistor 22 may have a resistance of 100Ω.

The TVS diodes 20 may have a working voltage higher than the voltage required to switch the vent and provide a sufficient ESD protection without reducing the efficiency of the vent. The resistor 22 avoids floating of to housing 17.

The ferrite beads 21 suppress high frequency noise getting picked up by the housing 17.

There are other possible configurations for ESD and EMI protection, e.g. using capacitors, RC filters, etc. In an exemplary embodiment, the TVS diodes 20 and the ferrite beads 21 shown in the embodiments of FIGS. 11 and 12 may be replaced with an ESD and/or EMI protection device of any type. It is also possible to have embodiments without ESD and/or EMI protection devices, in particular with regard to the audio lines 5.1, 5.2.

The grounding of the housing 17 of the receiver module 3 can be achieved as in the embodiments of FIG. 11 or 12 in any one of the other embodiments. ESD and/or EMI protection devices of any type may also be applied in the other embodiments.

In any of the above described embodiments, the controller module 2 may be configured as an on-the-ear part or a behind-the-ear part, wherein the receiver module 3 may be configured as an in-the-canal part.

In any of the above described embodiments, the hearing device 1 may be configured as a hearing aid.

Mechanical audio artefacts due to the switching of the vent may be addressed by improved mechanical damping and/or by playing a sound which masks the mechanical artefact (noise cancelling). Audio artefacts caused by the electrical signal used for switching the vent may be addressed by muting the audio signal or reducing the gain before switching.

LIST OF REFERENCES

1 hearing device
2 controller module
3 receiver module
4 speaker
5.1 audio line
5.2 audio line
6 inductor
6.1 first terminal
6.2 second terminal
7 capacitor
8 control output, output pin
9 control line
10 semiconductor driver
10.1 output
10.2 input, control input, signal input
10.3 input, control input, signal input
10.4 input
10.5 signal input
10.6 signal input
10.7 signal input
10.8 output
11 further control output, further output pin
12 transistor
13 transistor
14 first diode, first Schottky diode
15 second diode, second Schottky diode
16 ground wire
17 housing
18 ground
19 amplifier
20 TVS diode
21 ferrite bead
22 resistor
VBAT positive voltage, supply voltage

What is claimed is:

1. A hearing device, comprising:
a controller module; and
a receiver module including
a speaker and an active vent which can be switched between an open state and a closed state,
wherein the speaker is electrically connected to the controller module by two differential audio lines,
wherein the active vent comprises a solenoid with an inductor having a first terminal and a second terminal, the first terminal connected to the controller module via one of the differential audio lines and the second terminal connected to at least one control output of the controller module via a separate control line.

2. The hearing device of claim 1, wherein a capacitor is connected in series with the speaker.

3. The hearing device of claim 1, wherein the at least one control output is capable of adopting a high impedance state.

4. The hearing device according to claim 1, further comprising at least one semiconductor driver having at least one output and one or more inputs, wherein the second terminal of the inductor is connected to the at least one output of the semiconductor driver.

5. The hearing device according to claim 4, wherein at least one of the one or more inputs of the semiconductor driver is connected to the at least one control output of the controller module.

6. The hearing device of claim 4, wherein the at least one semiconductor driver comprises a tri state buffer.

7. The hearing device of claim 6, wherein the tri state buffer has an output, a signal input and an enable input, wherein the second terminal is connected to the output of the tri state buffer, wherein the signal input of the tri state buffer is connected to the at least one control output of the controller module, wherein the enable input of the tri state buffer is connected to another control output of the controller module.

8. The hearing device of claim 4, wherein the at least one semiconductor driver comprises a logic gate having an output, and at least two signal inputs, wherein the second terminal is connected to the output of the logic gate, wherein at least one of the signal inputs of the logic gate is connected to the at least one control output of the controller module, wherein another one of the signal inputs of the logic gate is connected to the differential audio line which is connected to the inductor.

9. The hearing device of claim 4, wherein the at least one semiconductor driver comprises two transistors arranged as a half-bridge, wherein the second terminal is connected to an output of the half-bridge, wherein a gate or base of each transistor is connected to a respective control output of the controller module.

10. The hearing device of claim 9, wherein the transistors comprise an n-channel field effect transistor and a p-channel field effect transistor respectively having a gate, a drain and a source, wherein the second terminal is connected to the source of the p-channel field effect transistor and to the drain of the n-channel field effect transistor, wherein each gate is connected to a respective control output of the controller module.

11. The hearing device of claim 9, wherein a capacitor is connected in parallel with the inductor, wherein a first Schottky diode is arranged to connect one of the transistors to a positive voltage and wherein a second Schottky diode is arranged to connect the other one of the transistors to mass.

12. The hearing device of claim 4, wherein the at least one semiconductor driver comprises a Schottky diode, wherein a capacitor is connected in parallel with the inductor, wherein the controller module comprises two output pins, one of them connected directly to the second terminal and the other one connected to the second terminal via the Schottky diode.

13. The hearing device of claim 4, wherein the at least one semiconductor driver comprises an analogue switch having an output, at least two control inputs and at least three signal inputs selectively switchable to the output depending on the state of the control inputs, wherein the second terminal is connected to the output, wherein each control input is connected to a respective control output of the controller module, wherein a first one of the signal inputs is connected to a high voltage, a second one of the signal inputs is connected to mass and a third one of the signal inputs is left open or connected to the differential audio line which is connected to the inductor.

14. The hearing device of claim 13, wherein a capacitor is connected in parallel with the inductor, wherein a Schottky diode is arranged to connect the second signal input to mass.

15. The hearing device of claim 4, wherein the at least one semiconductor driver comprises a DC/DC converter having a first output, a second output and at least two control inputs, wherein the DC/DC converter is configured to convert a supply voltage to a positive switch voltage which is higher than a voltage on the audio line and wherein the DC/DC converter is configured to convert a supply voltage to a negative switch voltage which is lower than the voltage on the audio line, wherein the second terminal is connected to the first output and to the second output, wherein the control inputs are configured to either switch the first output and the second output into a high impedance state or to switch the positive switch voltage to the first output or to switch the negative voltage to the second output, wherein the solenoid of the active vent is configured to switch only when supplied with a voltage which is higher or lower than the voltage on the audio line.

16. The hearing device according to claim 1, wherein a ground wire is arranged to connect a housing of the receiver module to a ground potential in the controller module.

17. The hearing device according to claim 1, wherein the a housing of the receiver module is also connected to the control line and a resistor is arranged to pull the control line to ground.

18. The hearing device according to claim 1, wherein at least one ESD and/or EMI protection device is arranged to protect the audio lines and/or the control line.

* * * * *